United States Patent [19]

Janotik

[11] Patent Number: 4,857,680

[45] Date of Patent: Aug. 15, 1989

[54] ACCELERATION SENSOR

[75] Inventor: Adam M. Janotik, Grosse Ile, Mich.

[73] Assignee: Ford Motor Company, Dearborn, Mich.

[21] Appl. No.: 288,382

[22] Filed: Dec. 22, 1988

[51] Int. Cl.[4] ..... H01H 35/14

[52] U.S. Cl. ..... 200/61.45 R; 200/61.53

[58] Field of Search ..... 200/61.45 R, 61.45 M, 200/61.48-61.53; 180/282, 283; 280/734, 735

[56] References Cited

U.S. PATENT DOCUMENTS

| | | | |
|---|---|---|---|
| 2,458,479 | 1/1949 | Perry | 200/61.53 |
| 2,930,863 | 3/1960 | Pasieka | 200/61.53 |
| 3,156,794 | 11/1964 | Vold | 200/61.45 R |
| 3,484,571 | 12/1969 | Williams | 200/61.53 |
| 3,571,539 | 3/1971 | Kaiser et al. | 200/61.53 |
| 3,688,063 | 8/1972 | Bell | 200/61.53 |
| 3,836,738 | 9/1974 | Baland | 200/61.45 R |
| 3,967,079 | 6/1976 | Sasaya et al. | 200/61.45 R |
| 3,974,350 | 8/1976 | Breed | 200/61.53 |
| 4,097,699 | 6/1978 | Larson | 200/61.45 R |
| 4,116,132 | 9/1978 | Bell | 102/200 |
| 4,329,549 | 5/1982 | Breed | 200/61.45 M |
| 4,536,629 | 8/1985 | Diller | 200/61.45 R |

*Primary Examiner*—J. R. Scott

*Attorney, Agent, or Firm*—Daniel M. Stock; Roger L. May

[57] ABSTRACT

An acceleration sensor is provided for electrically activating electrically operated automotive occupant restraints which employs switch contacts arranged in a cylindrical housing to resiliently bias a sensing mass in columnar fashion and collapse to effect contact upon movement of the sensing mass responsive to an acceleration pulse above a predetermined magnitude and duration.

21 Claims, 2 Drawing Sheets

ACCELERATION SENSOR

BACKGROUND OF THE INVENTION

The present invention relates generally to acceleration sensors and more specifically to acceleration sensors of the type adapted for use in an automotive vehicle equipped with an automatic occupant restraint device such as an air bag.

In the design of passive occupant restraint systems for modern passenger automobiles, it has been found desirable to place a number of acceleration sensors at selected locations on the body of a vehicle which electrically interconnect a source of electrical power and the passive occupant restraint system. For example, air bag restraint systems often employ an electrically operated igniter for activating a stored dry chemical for producing inflating gas for the air bag. Acceleration sensors are used to actuate the igniter.

The known acceleration sensors utilized for electrical activation of occupant restraint systems employ an acceleration sensing mass carried in a housing and preloaded to a rest position against inadvertent actuation and having its motion toward a position effecting the desired actuation damped in some fashion.

U.S. Pat. Nos. 3,974,350 to Breed and 4,097,699 to Larson are exemplary of such sensors, both including a gas damped mass moving against a mechanical spring load to effect switch actuation. U.S. Pat. No. 4,329,549 to Breed discloses a similar sensor in which a permanent magnet provides the preload force to the mass in a manner functionally similar to the springs of the previously mentioned patents, but since the mass moves away from the magnet during actuation, preloading force decreases with movement of the mass, which has been found to provide a desirable advantage for some vehicle acceleration sensing applications over the function of the spring-loaded mass devices previously used.

A disadvantage of the prior art sensors has been that while the sensors are functionally acceptable, their cost of manufacture has been relatively high. Difficulties in closely controlling peripheral clearances between the mass and the housing have created some of the manufacturability problems.

A co-pending application of applicant, U.S. Ser. No. 137,637, now U.S. Pat. No. 4,816,627, assigned to the assignee of the present invention, discloses an alternative design for a magnetically biased gas damped acceleration sensor, but it, along with sensors such as that disclosed in U.S. Pat. No. 4,329,549 to Breed, suffers from the additional disadvantage of relatively high weight because of the use of the permanent magnet as a biasing device.

SUMMARY OF THE INVENTION

Responsive to the disadvantages of the acceleration sensors of the prior art, it is an object of the present invention to provide a sensor that employs a gas damped sliding mass that is preloaded against movement in a manner in which the preload force reduces with movement of the mass toward an actuating position without imposing magnetic preloading forces on the mass.

It is a further object of the present invention to provide such a sensor which is economically and repeatably reproducible.

According to a feature of the present invention, the acceleration sensing mass is biased through abutting engagement with a switch contact formed in columnar fashion and arranged to collapse to a position engaging another switch contact upon occurrence of an acceleration pulse of predetermined magnitude and duration.

According to another feature of the present invention, the sensor is formed having a simple cylindrical glass housing closed by a plug which carries the contacts into position abuttingly engaging the sliding mass.

BRIEF DESCRIPTION OF THE DRAWINGS

These and other objects and features of the present invention will be apparent to those skilled in the automotive occupant restraint arts upon reading the following description with reference to the accompanying drawings in which.

DESCRIPTION OF THE PREFERRED EMBODIMENT

Figure 1:
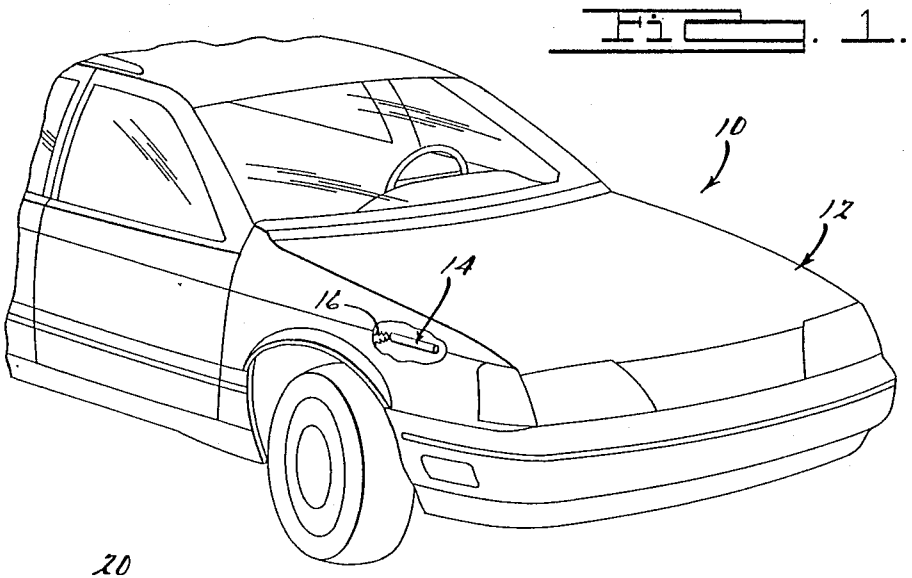
FIG. 1 is a perspective view of an automobile in which the sensor of the present invention is mounted.

Turning now to the drawings and in particular to FIG. 1 thereof, an automotive vehicle 10 is illustrated as including a body indicated generally at 12 in which is mounted by appropriate means (not illustrated) an acceleration sensor 14. The sensor 14 is electrically connected as by wiring indicated at 16 to an electrical power supply 18 as indicated schematically in FIG. 2 and to an electrically operated occupant restraint system such as the inflatable restraint indicated at 20 in FIG. 2.

The sensor 14 is illustrated as comprising a housing 22, an acceleration sensing mass 24 and a contact subassembly 26. The housing 22 is preferably formed as a glass tube having an axially extending bore 28 which terminates at a wall 30 closing one end.

Figure 2:
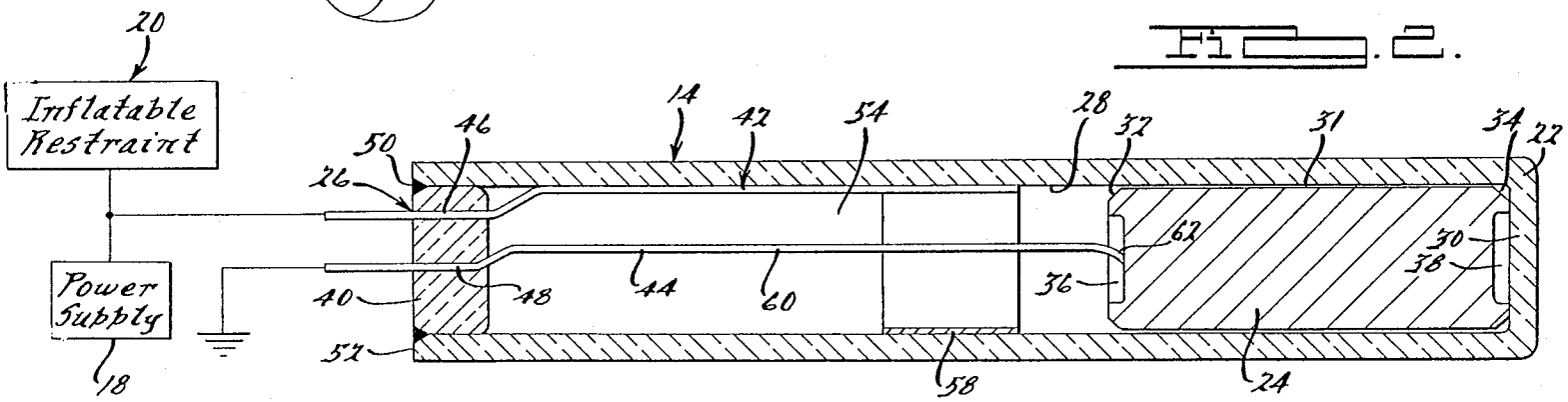
FIG. 2 is a cross-sectional view of a sensor according to the present invention with its components in their assembled positions.

The acceleration sensing mass 24 is formed from a relatively dense material and may, for example, be fabricated as a powered metal part or an impact extrusion to facilitate manufacturing owing to its simple shape as illustrated in FIG. 2. It is formed as an elongated cylindrical member having its outer diameter sized to provide a predetermined clearance 31 within the bore 28. It is a symmetrically constructed part and the outer surface of each end is chamfered as indicated at 32, 34 to facilitate insertion into the bore 28, and centrally located recesses 36, 38 are provided at each end. Provision of the recess 38 at the end of the mass 24 which is abuttingly engageable with the wall 30 facilitates location and operation of the mass 24 by reducing the contact area with the wall 30. Provision of the recess 36 at the other end of the mass 24 provides a locating and retaining pocket for receiving a portion of the contact subassembly 26 as may readily be seen in FIGS. 2 and 4.

The contact subassembly 26 consists of a cylindrical plug 40, preferably formed as a glass part, a ring contact 42 and a columnar contact 44. The plug 40 is configured to engage mounting portions 46, 48 of the ring contact 42 and the columnar contact 44, respectively, in hermetically sealed fashion in a known manner. The plug in turn is sealed as indicated at 50 to the housing 22 adjacent its open end 52. The plug 40, therefore, closes the housing 22 to define a sensing chamber 54 within it.

Figure 3:
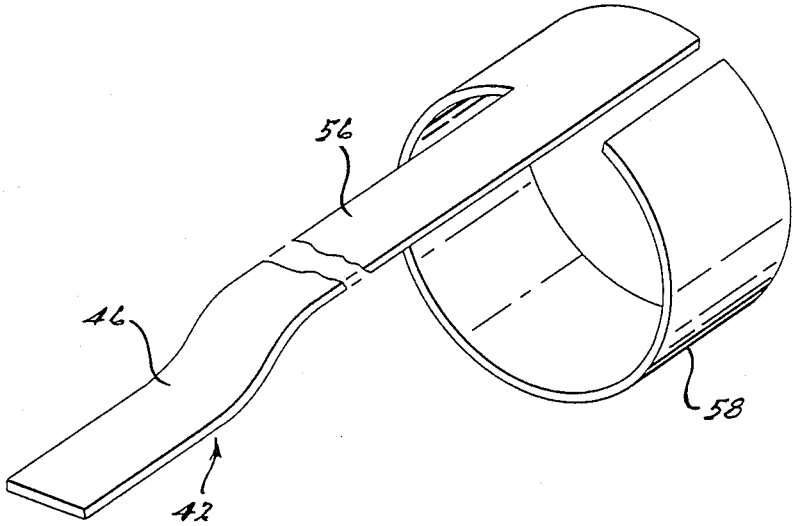
FIG. 3 is an enlarged perspective view of one of the contacts of the sensor of the present invention.

The ring contact 42, as may best be seen in FIG. 3, is a formed strip or blade member that may be fabricated from any suitable electrically conductive material having appropriate elasticity for performing the functions of the contacts 42, 44. Those skilled in the sensor design arts will appreciate that such materials may include alloys of copper which include beryllium, commonly referred to as "beryllium copper", and stainless steel of the 400 series as defined by the Society of Automotive Engineers. In addition to the mounting portion 46, the ring contact 42 includes an elongated connecting strip 56 which joins the mounting portion 46 to a circumferentially extending contact plate 58. In the assembled position shown in FIG. 2, the contact Plate 58 is positioned within the chamber 54 near the normal assembled position of the acceleration sensing mass 24.

The columnar contact 44 includes a connecting portion 60 which extends from the mounting portion 48 to a turned-over contact portion 62. The connecting portion 60 is radially offset from the axes of the bore 28 and the sensing mass 24.

It can be appreciated that assembly of the sensor 14 of the present invention may be accomplished rather simply utilizing well-known manufacturing techniques, such as have been employed in the production of light bulbs and vacuum tubes. The sensing mass 24 is first placed into the assembled position shown in FIG. 2 within the glass housing 22. Then the contact subassembly 26 is inserted to close the housing 22, and the plug 40 in the housing 22 may be laser fused into sealing engagement. It is highly preferable that this assembly and sealing process take place in an inert atmosphere so that the sensing chamber 54 can be filled with a dry inert gas, such as argon and nitrogen to eliminate corrosion and greatly lengthen the useful life of the sensor 14. If the chamber 54 is defined in an assembly process that does not provide for filling the chamber 54 with a dry inert gas and hermetically sealing the chamber, choices of materials and surface treatments for the components of the sensor 14 must consider corrosion protection.

OPERATION OF THE PREFERRED EMBODIMENT

As is indicated in FIG. 1, the sensor 14 is positioned in the body 12 of the vehicle 10 so that the closed end of the housing 22 faces the front of the vehicle at which location an impact may occur. It may be understood, however, that other sensors may be placed in the vehicle positioned to face other locations likely to sense impacts of the character that would activate the inflatable restraint 20.

Figure 4:
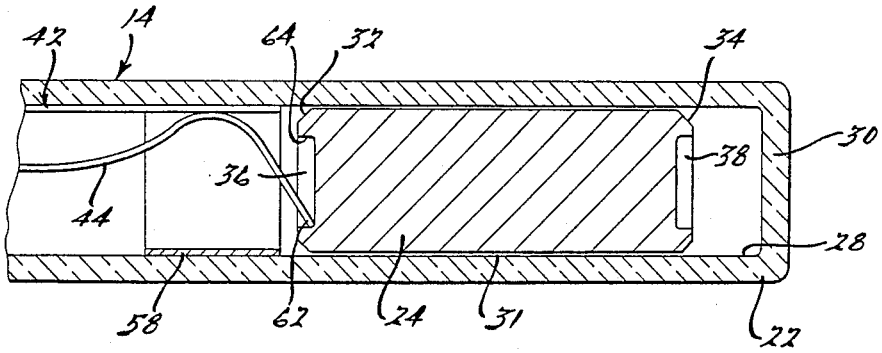
FIG. 4 is a partial cross-sectional view similar to FIG. 2 of the sensor showing movement of the components of the sensor to operative positions.

In the installed position shown in FIG. 2, the sensing mass 24 abuttingly engages the wall 30 of the housing 22, resilient urged into that position by the columnar contact portion 62 of contact 44. Upon the occurrence of an impact resulting in an acceleration pulse of a predetermined magnitude and duration, the sensing mass 24 slides along the bore 28 and collapses the columnar contact 44, bowing it outwardly in the direction of its radial offset to engage the contact plate 58 while the contact portion 62 is retained within the outer wall of the sensing mass recess 36, as is illustrated in FIG. 4. This completes the electrical circuit between power supply 18 and the inflatable restraint 20 to activate the passive occupant restraint system of the vehicle 10. The cross-section and the length of the columnar contact 44 are chosen to provide a threshold resistance to movement by the mass 24 preventing inadvertent actuation of the inflatable restraint 20 in response to acceleration pulses below a predetermined magnitude. The columnar contact 44 is essentially a column having one free end and the other built-in and the force necessary to cause its collapse computed using Euler's formula:

$$F=2.05\,\pi^2(EI/l^2)$$

where:

E=Modulus of Elasticity

I=Second Moment of Area of Column Cross Section l=Length of Column

When the force exerted by the mass 24 on the columnar contact 44 exceeds the threshold force, collapse toward the position of FIG. 4 begins and the contact 44 acts in the manner of a negative rate spring (like a magnetic biasing force) to provide a resisting force to the mass which diminishes in proportion to the distance travelled from the assembled position. As the mass 24 moves within the bore 28, gas in the sensing chamber 54 is transferred from one end of the mass 24 to the other, providing a velocity dependent damping force on the mass 24. Through appropriate experimentation, the cross-section and length of the contact 42 and the mass and radial clearance of the acceleration sensing mass 24 with respect to the housing bore 28 may be chosen to produce an actuation response characteristic for the sensor 14 which is appropriate for operating the inflatable restraint 20 of the vehicle 10 rapidly while preventing inadvertent actuations.

While only one embodiment of the invention acceleration sensor has been disclosed, others may be possible without departing from the scope of the appended claims.

I claim:

1. An acceleration sensor for transmitting an electrical signal from a power supply to an inflatable occupant restraint system of an automobile upon the occurrence of an acceleration pulse of predetermined magnitude and duration, the sensor comprising:

an elongated housing adapted to be mounted in the vehicle and having an axially extending bore extending from an open end of the housing and terminating at a closed end;

a sensing mass slidingly received in the bore and having a cylindrical outer surface sized to define a predetermined diametral clearance with the bore;

a plug sealingly engaged with the housing to close the housing open end and therewith define a closed sensing chamber;

a columnar contact member formed of electrically conductive material as a resilient blade member sealingly carried by the plug and extending therethrough and having a contact portion abuttingly engaging the sensing mass to urge the sensing mass toward the housing closed end and a connecting column portion extending between the contact portion and the plug; and a ring contact member formed of electrically conductive material, sealingly carried by the plug and extending therethrough and having a circumferentially extending contact plate received in the bore in axial registration with a portion of the connecting column portion and radially spaced therefrom, the collapsing column contact member and the ring contact member defining a normally open switch connected between the power supply and the inflatable occupant restraint system;

whereby upon the occurrence of the predetermined acceleration pulse, the sensing mass slides away from the housing closed end, deflecting the column portion into engagement with the contact plate to transmit the electrical signal from the power supply to the inflatable occupant restraint system.

2. A sensor as defined in claim 1, wherein the housing is fabricated from glass.

3. A sensor as defined in claim 1, wherein the housing and the plug are fabricated from glass.

4. A sensor as defined in claim 1, wherein the sensing chamber is filled with a dry inert gas.

5. A sensor as defined in claim 4, wherein the gas is argon.

6. A sensor as defined in claim 4, wherein the gas is nitrogen.

7. A sensor as defined in claim 1, wherein the columnar contact member and the ring contact member are fabricated from beryllium copper.

8. A sensor as defined in claim 1, wherein the columnar contact member and the ring contact member are fabricated from stainless steel.

9. A sensor as defined in claim 1, wherein the connecting column portion is radially offset from the contact portion.

10. An acceleration sensor for transmitting an electrical signal from a power supply to an inflatable occupant restraint system of an automobile upon the occurrence of an acceleration pulse of predetermined magnitude and duration, the sensor comprising:

an elongated housing adapted to be mounted in the vehicle and having an axially extending bore extending from an open end of the housing and terminating at a closed end;

a sensing mass slidingly received in the bore and having a cylindrical outer surface sized to define a predetermined diametral clearance with the bore;

a plug sealingly engaged with the housing to close the housing open end and therewith define a closed sensing chamber;

a columnar contact member formed of electrically conductive material as a resilient blade member sealingly carried by the plug and extending therethrough and having a contact portion abuttingly engaging the sensing mass to urge the sensing mass toward the housing closed end and a connecting column portion radially offset from the contact portion; and a ring contact member formed of electrically conductive material, sealingly carried by the plug and extending therethrough and having a circumferentially extending contact plate received in the bore in axial registration with a portion of the connecting column portion and radially spaced therefrom, the collapsing column contact member and the ring contact member defining a normally open switch connected between the power supply and the inflatable occupant restraint system;

whereby upon the occurrence of the predetermined acceleration pulse, the sensing mass slides away from the housing closed end, deflecting the column portion into engagement with the contact plate to transmit the electrical signal from the power supply to the inflatable occupant restraint system.

11. A sensor as defined in claim 10, wherein the housing is fabricated from glass.

12. A sensor as defined in claim 10, wherein the housing and the plug are fabricated from glass.

13. A sensor as defined in claim 10, wherein the sensing chamber is filled with a dry inert gas.

14. A sensor as defined in claim 13, wherein the gas is argon.

15. A sensor as defined in claim 13, wherein the gas is nitrogen.

16. A sensor as defined in claim 10, wherein the columnar contact member and the ring contact member are fabricated from beryllium copper.

17. A sensor as defined in claim 10, wherein the columnar contact member and the ring contact member are fabricated from stainless steel.

18. A sensor as defined in claim 10, wherein the sensing mass comprises a cylindrical member having a central recess formed on at least one end for receiving the contact portion.

19. An acceleration sensor for transmitting an electrical signal upon the occurrence of an acceleration pulse of predetermined magnitude and duration, the sensor comprising:

an elongated housing adapted to be mounted in the vehicle and having an axially extending bore extending from an open end of the housing and terminating at a closed end;

a sensing mass slidingly received in the bore and having a cylindrical outer surface sized to define a predetermined diametral clearance with the bore;

a plug sealingly engaged with the housing to close the housing open end and therewith define a closed sensing chamber;

a columnar contact member formed of electrically conductive material as a resilient blade member sealingly carried by the plug and extending therethrough and having a contact portion abuttingly engaging the sensing mass to urge the sensing mass toward the housing closed end and a connecting column portion extending between the contact portion and the plug; and a ring contact member formed of electrically conductive material, sealingly carried by the plug and extending therethrough and having a circumferentially extending contact plate received in the bore in axial registration with a portion of the connecting column portion and radially spaced therefrom, the columnar contact member and the ring contact member defining a normally open switch;

whereby upon the occurrence of the predetermined acceleration pulse, the sensing mass slides away from the housing closed end, deflecting the column portion into engagement with the contact plate to transmit the electrical signal.

20. A sensor as defined in claim 19, wherein the connecting column portion is radially offset from the contact portion.

21. An acceleration sensor for transmitting an electrical signal from a power supply to an inflatable occupant restraint system of an automobile, the sensor comprising:

a housing having an axially extending bore including a closed end;

a sensing mass mounted in the housing at the closed end for damped slidable movement along an axis of the housing bore in response to changes in the velocity of the automobile with respect to the axis;

a fixed electrical contact fixedly mounted within the housing bore; and a deflectable electrical contact having an end fixedly carried with the housing and having a contact portion resiliently engaging the sensing mass in columnar fashion to bias the mass in one direction with respect to the housing, the sensing mass being operative upon the occurrence of an acceleration pulse of predetermined magnitude to move to collapse the deflectable contact, reducing the biasing force thereof porportional to the movement and causing portions of the deflectable contact to engage the fixed electrical contact, thereby transmitting the electrical signal.

* * * * *